US008532982B2

(12) United States Patent
Oh et al.

(10) Patent No.: US 8,532,982 B2
(45) Date of Patent: Sep. 10, 2013

(54) METHOD AND APPARATUS TO ENCODE AND DECODE AN AUDIO/SPEECH SIGNAL

(75) Inventors: Eun Mi Oh, Seongnam-si (KR); Jung Hoe Kim, Seongnam-si (KR); Ki Hyun Choo, Seoul (KR); Ho Sang Sung, Yongin-si (KR); Mi Young Kim, Hwaseong-si (KR)

(73) Assignee: SAMSUNG Electronics Co., Ltd., Suwon-si (KR)

( * ) Notice: Subject to any disclaimer, the term of this patent is extended or adjusted under 35 U.S.C. 154(b) by 1011 days.

(21) Appl. No.: 12/502,454

(22) Filed: Jul. 14, 2009

(65) Prior Publication Data

US 2010/0010807 A1 Jan. 14, 2010

(30) Foreign Application Priority Data

Jul. 14, 2008 (KR) ..... 10-2008-68377

(51) Int. Cl.
*G10L 19/00* (2006.01)

(52) U.S. Cl.
USPC ..... 704/200.1; 704/500; 704/230; 704/216; 704/229; 704/223; 381/22; 381/23; 375/240; 375/242; 370/352

(58) Field of Classification Search
USPC ..... 704/500–504, 200.1, 230, 216–218, 704/221–223, 203, 229; 381/22, 23; 375/240, 375/242; 370/352, 392
See application file for complete search history.

(56) References Cited

U.S. PATENT DOCUMENTS

| | | | | |
|---|---|---|---|---|
| 5,651,090 | A * | 7/1997 | Moriya et al. | 704/200.1 |
| 6,704,705 | B1 * | 3/2004 | Kabal et al. | 704/230 |
| 6,766,293 | B1 * | 7/2004 | Herre et al. | 704/226 |
| 6,975,254 | B1 * | 12/2005 | Sperschneider et al. | 341/107 |
| 7,240,001 | B2 * | 7/2007 | Chen et al. | 704/230 |
| 7,269,550 | B2 | 9/2007 | Tsushima et al. | |
| 7,328,162 | B2 * | 2/2008 | Liljeryd et al. | 704/503 |
| 7,330,812 | B2 * | 2/2008 | Ding | 704/200.1 |
| 7,761,290 | B2 * | 7/2010 | Koishida et al. | 704/222 |
| 7,885,819 | B2 * | 2/2011 | Koishida et al. | 704/500 |
| 7,917,369 | B2 * | 3/2011 | Chen et al. | 704/500 |
| 7,936,785 | B2 * | 5/2011 | Ehret et al. | 370/473 |
| 8,046,214 | B2 * | 10/2011 | Mehrotra et al. | 704/200.1 |

(Continued)

FOREIGN PATENT DOCUMENTS

| | | |
|---|---|---|
| CN | 1677490 | 10/2005 |
| CN | 1787078 | 6/2006 |

(Continued)

OTHER PUBLICATIONS

Chinese Office Action Issued on May 8, 2012 in CN Patent Application No. 12/502,454.

(Continued)

*Primary Examiner* — Vijay B Chawan
(74) *Attorney, Agent, or Firm* — Stanzione & Kim, LLP

(57) ABSTRACT

A method and apparatus to encode and decode an audio/speech signal is provided. An inputted audio signal or speech signal may be transformed into at least one of a high frequency resolution signal and a high temporal resolution signal. The signal may be encoded by determining an appropriate resolution, the encoded signal may be decoded, and thus the audio signal, the speech signal, and a mixed signal of the audio signal and the speech signal may be processed.

23 Claims, 17 Drawing Sheets

(56) References Cited

U.S. PATENT DOCUMENTS

| | | | | |
|---|---|---|---|---|
| 2003/0004711 | A1 | 1/2003 | Koishida et al. | |
| 2004/0125878 | A1* | 7/2004 | Liljeryd et al. | 375/242 |
| 2006/0004566 | A1 | 1/2006 | Oh et al. | |
| 2007/0140359 | A1* | 6/2007 | Ehret et al. | 375/246 |
| 2007/0156725 | A1* | 7/2007 | Ehret et al. | 707/100 |
| 2007/0168183 | A1 | 7/2007 | Van De Kerkhof | |
| 2010/0322429 | A1* | 12/2010 | Norvell et al. | 381/22 |

FOREIGN PATENT DOCUMENTS

| | | | |
|---|---|---|---|
| CN | 1922654 | | 2/2007 |
| EP | 0762386 | | 3/1997 |
| EP | 1873753 | A1 * | 1/2008 |
| JP | 2004-004710 | | 1/2004 |
| JP | 2006-011456 | | 1/2006 |
| WO | 01-65544 | | 7/2001 |
| WO | 2005/096508 | | 10/2005 |
| WO | 2007066970 | | 6/2007 |

OTHER PUBLICATIONS

"Global Analysis Laboratory Report for Phase-1 of the 3GPP Audio Codec Characterization Test for PSS-MMS-MBMS," Dynastat, 3GPP TSG-SA4 Meeting #35, San Diego, California, May 9-13, 2005, Tdoc S4-050407.

"A New Orthonormal Wavelet Packet Decomposition for Audio Coding Using Frequency-Varying Modulated Lapped Transforms," Purat et al.

Israel Office Action dated Dec. 20, 2012 issued in Israel Application No. 210664.

Chinese Office Action dated Dec. 24, 2012 issued in CN Application No. 200980135987.5.

Japanese Office Action dated Jun. 4, 2013 issued in JP Application No. 2011-518646.

* cited by examiner

METHOD AND APPARATUS TO ENCODE AND DECODE AN AUDIO/SPEECH SIGNAL

CROSS-REFERENCE TO RELATED APPLICATIONS

This application claims priority under 35 U.S.C. §119(a) from Korean Patent Application No. 10-2008-0068377, filed on Jul. 14, 2008, in the Korean Intellectual Property Office, the disclosure of which is incorporated herein in its entirety by reference.

BACKGROUND

1. Field of the Invention

Example embodiments relate to a method and apparatus to encode and decode an audio/speech signal.

2. Description of the Related Art

A codec may be classified into a speech codec and an audio codec. A speech codec may encode/decode a signal in a frequency band in a range of 50 Hz to 7 kHz using a speech modeling. In general, the speech codec may extract a parameter of a speech signal by modeling vocal cords and vocal tracts to perform encoding and decoding. An audio codec may encode/decode a signal in a frequency band in a range of 0 Hz to 24 Hz by applying a psychoacoustic modeling such as a High Efficiency-Advanced Audio Coding (HE-AAC). The audio codec may perform encoding and decoding by removing a less perceptible signal based on human hearing features.

Although a speech codec is suitable for encoding/decoding a speech signal, it is not suitable for encoding/decoding an audio signal due to degradation of a sound quality. Also, a signal compression efficiency may be reduced when an audio codec encode/decodes a speech signal.

SUMMARY

Example embodiments may provide a method and apparatus of encoding and decoding an audio/speech signal that may efficiently encode and decode a speech signal, an audio signal, and a mixed signal of the speech signal and the audio signal.

Additional features and utilities of the present general inventive concept will be set forth in part in the description which follows and, in part, will be obvious from the description, or may be learned by practice of the general inventive concept.

According to example embodiments of the present general inventive concept, there may be provided an apparatus to encode an audio/speech signal, the apparatus including a signal transforming unit to transform an inputted audio signal or speech signal into at least one of a high frequency resolution signal and a high temporal resolution signal, a psychoacoustic modeling unit to control the signal transforming unit, a time domain encoding unit to encode the signal, transformed by the signal transforming unit, based on a speech modeling, and a quantizing unit to quantize the signal outputted from at least one of the signal transforming unit and the time domain encoding unit.

According to example embodiments of the present general inventive concept, there may also be provided an apparatus to encode an audio/speech signal, the apparatus including a parametric stereo processing unit to process stereo information of an inputted audio signal or speech signal, a high frequency signal processing unit to process a high frequency signal of the inputted audio signal or speech signal, a signal transforming unit to transform the inputted audio signal or speech signal into at least one of a high frequency resolution signal and a high temporal resolution signal, a psychoacoustic modeling unit to control the signal transforming unit, a time domain encoding unit to encode the signal, transformed by the signal transforming unit, based on a speech modeling, and a quantizing unit to quantize the signal outputted from at least one of the signal transforming unit and the time domain encoding unit.

According to example embodiments of the present general inventive concept, there may also be provided an apparatus to encode an audio/speech signal, the apparatus including a signal transforming unit to transform an inputted audio signal or speech signal into at least one of a high frequency resolution signal and a high temporal resolution signal, a psychoacoustic modeling unit to control the signal transforming unit, a low rate determination unit to determine whether the transformed signal is in a low rate, a time domain encoding unit to encode the transformed signal based on a speech modeling when the transformed signal is in the low rate, a temporal noise shaping unit to shape the transformed signal, a high rate stereo unit to encode stereo information of the shaped signal, and a quantizing unit to quantize at least one of an output signal from the high rate stereo unit and an output signal from the time domain encoding unit.

According to example embodiments of the present general inventive concept, there may be also provided an apparatus to decode an audio/speech signal, the apparatus including a resolution decision unit to determine whether a current frame signal is a high frequency resolution signal or a high temporal resolution signal, based on information about time domain encoding or frequency domain encoding, the information being included in a bitstream, a dequantizing unit to dequantize the bitstream when the resolution decision unit determines the signal is the high frequency resolution signal, a time domain decoding unit to decode additional information for inverse linear prediction from the bitstream, and restore the high temporal resolution signal using the additional information, and an inverse signal transforming unit to inverse-transform at least one of an output signal from the time domain decoding unit and an output signal from the dequantizing unit into an audio signal or speech signal of a time domain.

According to example embodiments of the present general inventive concept, there may also be provided an apparatus to decode an audio/speech signal, the apparatus including a dequantizing unit to dequantize a bitstream, a high rate stereo/decoder to decode the dequantized signal, a temporal noise shaper/decoder to process the signal decoded by the high rate stereo/decoder, and an inverse signal transforming unit to inverse-transform the processed signal into an audio signal or speech signal of a time domain, wherein the bitstream is generated by transforming the inputted audio signal or speech signal into at least one of a high frequency resolution signal and a high temporal resolution signal.

According to example embodiments of the present general inventive concept, a method and apparatus to encode and decode an audio/speech signal may efficiently encode and decode a speech signal, an audio signal, and a mixed signal of the speech signal and the audio signal.

Also, according to example embodiments of the present general inventive concept, a method and apparatus to encode and decode an audio/speech signal may perform encoding and decoding with less bits, and thereby may improve a sound quality.

Additional utilities of the example embodiments will be set forth in part in the description which follows and, in part, will be apparent from the description, or may be learned by practice of the embodiments.

Exemplary embodiments of the present general inventive concept also provide a method of encoding audio and speech signals, the method including receiving at least one audio signal and at least one speech signal, transforming the at least one of the received audio signal and the received speech signal into at least one of a frequency resolution signal and a temporal resolution signal, encoding the transformed signal, and quantizing at least one of the transformed signal and the encoded signal.

Exemplary embodiments of the present general inventive concept also provide a method of decoding audio and speech signals, the method including determining whether a current frame signal is a frequency resolution signal or a temporal resolution signal with information in the bitstream of a received signal about time domain encoding or frequency domain encoding, dequantizing the bitstream when the received signal is the frequency resolution signal, inverse linear predicting from the information in the bitstream and restoring the temporal resolution signal using the information, and inverse-transforming at least one of the dequantized signal and the restored temporal resolution signal into an audio signal or speech signal of a time domain.

BRIEF DESCRIPTION OF THE DRAWINGS

These and/or other features and utilities of the present general inventive concept will become apparent and more readily appreciated from the following description of the example embodiments, taken in conjunction with the accompanying drawings of which.

DETAILED DESCRIPTION OF THE EMBODIMENTS

Figure 1:
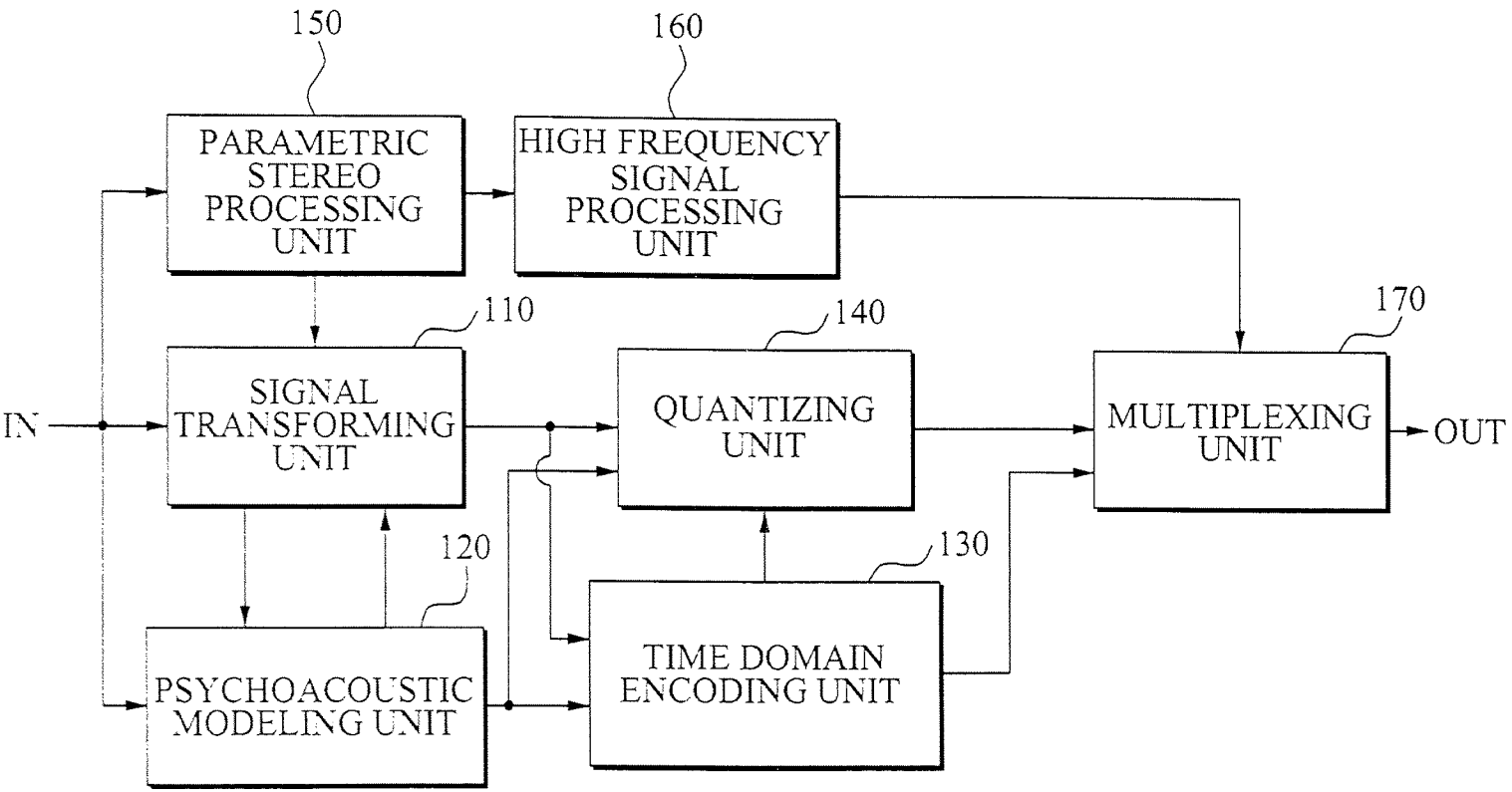
FIG. 1 is a block diagram illustrating an apparatus to encode an audio/speech signal according to exemplary embodiments of the present general inventive concept.

Reference will now be made in detail to example embodiments, examples of which are illustrated in the accompanying drawings, wherein like reference numerals refer to the like elements throughout. Example embodiments are described below to explain the present disclosure by referring to the figures.

FIG. 1 is a block diagram illustrating an apparatus to encode an audio/speech signal according to exemplary embodiments of the present general inventive concept.

Referring to FIG. 1, the apparatus of encoding an audio/speech signal may include a signal transforming unit 110, a psychoacoustic modeling unit 120, a time domain encoding unit 130, a quantizing unit 140, a parametric stereo processing unit 150, a high frequency signal processing unit 160, and a multiplexing unit 170.

The signal transforming unit 110 may transform an inputted audio signal or speech signal into a high frequency resolution signal and/or a high temporal resolution signal.

The psychoacoustic modeling unit 120 may control the signal transforming unit 110 to transform the inputted audio signal or speech signal into the high frequency resolution signal and/or the high temporal resolution signal.

Specifically, the psychoacoustic modeling unit 120 may calculate a masking threshold for quantizing, and control the signal transforming unit 110 to transform the inputted audio signal or speech signal into the high frequency resolution signal and/or the high temporal resolution signal with at least the calculated masking threshold.

The time domain encoding unit 130 may encode the signal, transformed by the signal transforming unit 110, with at least a speech modeling.

In particular, the psychoacoustic modeling unit 120 may provide the time domain encoding unit 130 with an information signal to control the time domain encoding unit 130.

In this instance, the time domain encoding unit 130 may include a predicting unit (not illustrated). The predicting unit may encode data by application of the speech modeling to the signal transformed by the signal transforming unit 110, and removal of correlation information. Also, the predicting unit may include a short-term predictor and a long-term predictor.

The quantizing unit 140 may quantize and encode the signal outputted from the signal transforming unit 110 and/or the time domain encoding unit 130.

In this instance, the quantizing unit 140 may include a Code Excitation Linear Prediction (CELP) unit to model a signal where correlation information is removed. The CELP unit is not illustrated in FIG. 1.

The parametric stereo processing unit 150 may process stereo information of the inputted audio signal or speech signal. The high frequency signal processing unit 160 may process high frequency information of the inputted audio signal or speech signal.

The apparatus to encode an audio/speech signal is described in greater detail below.

The signal transforming unit 110 may divide spectrum coefficients into a plurality of frequency bands. The psychoacoustic modeling unit 120 may analyze a spectrum characteristic and determine a temporal resolution or a frequency resolution of each of the plurality of frequency bands.

When a high temporal resolution is appropriate for a particular frequency band, a spectrum coefficient in the particular frequency band may be transformed by an inverse transforming unit utilizing a transform scheme such as an Inverse Modulated Lapped Transform (IMLT) unit, and the transformed signal may be encoded by the time domain encoding unit 130. The inverse transforming unit may be included in the signal transforming unit 110.

In this instance, the time domain encoding unit 130 may include the short-term predictor and the long-term predictor.

When the inputted signal is a speech signal, the time domain encoding unit 130 may efficiently reflect a characteristic of a speech generation unit due to increased temporal resolution. Specifically, the short-term predictor may process data received from the signal transforming unit 110, and remove short-term correlation information of samples in a time domain. Also, the long-term predictor may process residual signal data where a short-term prediction has been performed, and thereby may remove long-term correlation information.

The quantizing unit 140 may calculate a step-size of an inputted bit rate. The quantized samples and additional information of the quantizing unit 140 may be processed to remove statistical correlation information that may include, for example, an arithmetic coding or a Huffman coding.

The parametric stereo processing unit 150 may be operated at a bit rate less than 32 kbps. Also, an extended Moving Picture Experts Group (MPEG) stereo processing unit may be used as the parametric stereo processing unit 150. The high frequency signal processing unit 160 may efficiently encode the high frequency signal.

The multiplexing unit 170 may output an output signal of one or more of the units described above as a bitstream. The bitstream may be generated using a compression scheme such as the arithmetic coding, or a Huffman coding, or any other suitable compression coding.

Figure 2:
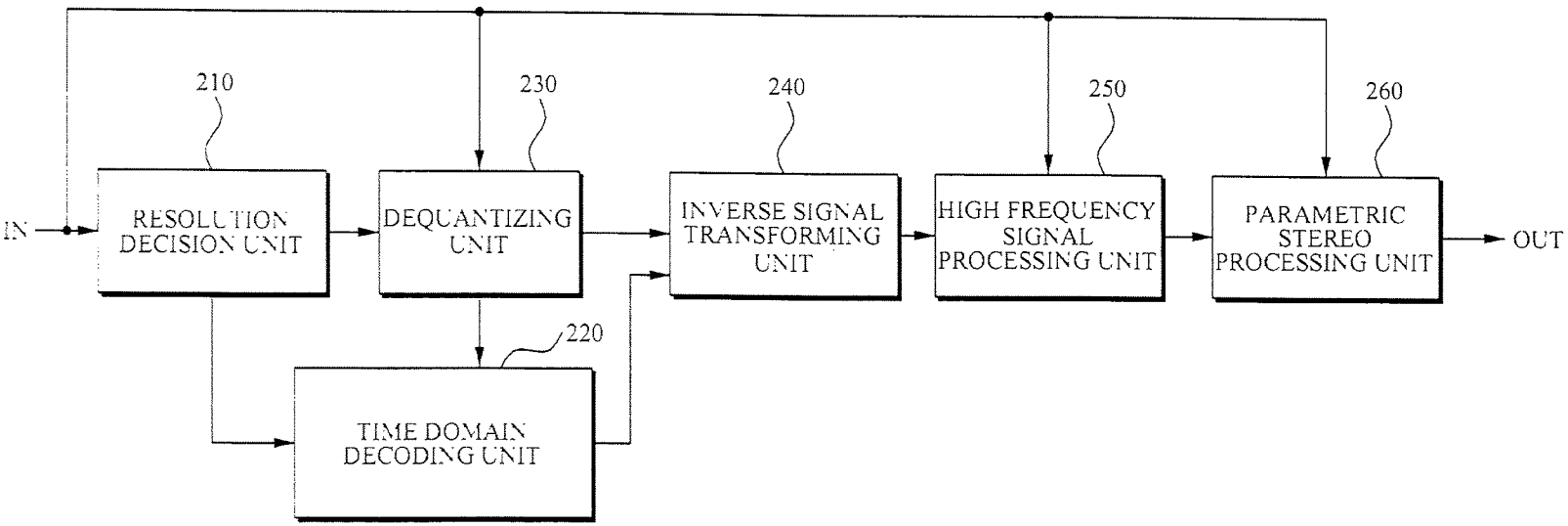
FIG. 2 is a block diagram illustrating an apparatus to decode an audio/speech signal according to exemplary embodiments of the present general inventive concept.

FIG. 2 is a block diagram illustrating an apparatus to decode an audio/speech signal according to exemplary embodiments of the present general inventive concept.

Referring to FIG. 2, the apparatus to decode an audio/speech signal may include a resolution decision unit 210, a time domain decoding unit 220, a dequantizing unit 230, an inverse signal transforming unit 240, a high frequency signal processing unit 250, and a parametric stereo processing unit 260.

The resolution decision unit 210 may determine whether a current frame signal is a high frequency resolution signal or a high temporal resolution signal, based on information about time domain encoding or frequency domain encoding. The information may be included in a bitstream.

The dequantizing unit 230 may dequantize the bitstream based on an output signal of the resolution decision unit 210.

The time domain decoding unit 220 may receive the dequantized signal from the dequantizing unit 230, decode additional information for inverse linear prediction from the bitstream, and restore the high temporal resolution signal with at least the additional information and the dequantized signal.

The inverse signal transforming unit 240 may inverse-transform an output signal from the time domain decoding unit 220 and/or the dequantized signal from the dequantizing unit 230 into an audio signal or speech signal of a time domain.

An inverse Frequency Varying Modulated Lapped Transform (FV-MLT) may be the inverse signal transforming unit 240.

The high frequency signal processing unit 250 may process a high frequency signal of the inverse-transformed signal, and the parametric stereo processing unit 260 may process stereo information of the inverse-transformed signal.

The bitstream may be inputted to the dequantizing unit 230, the high frequency signal processing unit 250, and the parametric stereo processing unit 260 to be decoded.

Figure 3:
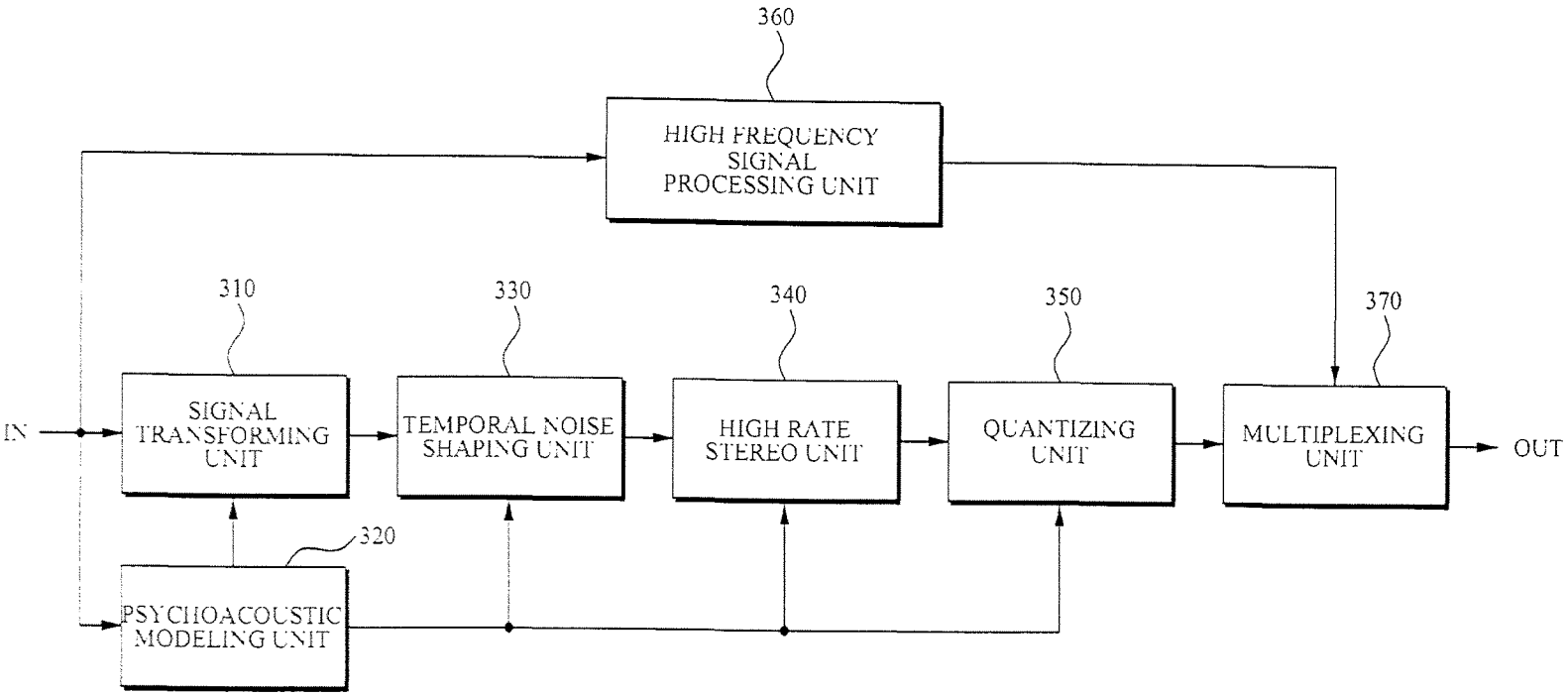
FIG. 3 is a block diagram illustrating an apparatus to encode an audio/speech signal according to exemplary embodiments of the present general inventive concept.

FIG. 3 is a block diagram illustrating an apparatus to encode an audio/speech signal according to exemplary embodiments of the present general inventive concept.

Referring to FIG. 3, the apparatus to encode an audio/speech signal may include a signal transforming unit 310, a psychoacoustic modeling unit 320, a temporal noise shaping unit 330, a high rate stereo unit 340, a quantizing unit 350, a high frequency signal processing unit 360, and a multiplexing unit 370.

The signal transforming unit 310 may transform an inputted audio signal or speech signal into a high frequency resolution signal and/or a high temporal resolution signal.

A Modified Discrete Cosine Transform (MDCT) may be used as the signal transforming unit 310.

The psychoacoustic modeling unit 320 may control the signal transforming unit 310 to transform the inputted audio signal or speech signal into the high frequency resolution signal and/or the high temporal resolution signal.

The temporal noise shaping unit 330 may shape a temporal noise of the transformed signal.

The high rate stereo unit 340 may encode stereo information of the transformed signal.

The quantizing unit 350 may quantize the signal outputted from the temporal noise shaping unit 330 and/or the high rate stereo unit 340.

The high frequency signal processing unit 360 may process a high frequency signal of the audio signal or the speech signal.

The multiplexing unit 370 may output an output signal of each of the units described above as a bitstream. The bitstream may be generated using a compression scheme such as an arithmetic coding, or a Huffman coding, or any other suitable coding.

Figure 4:
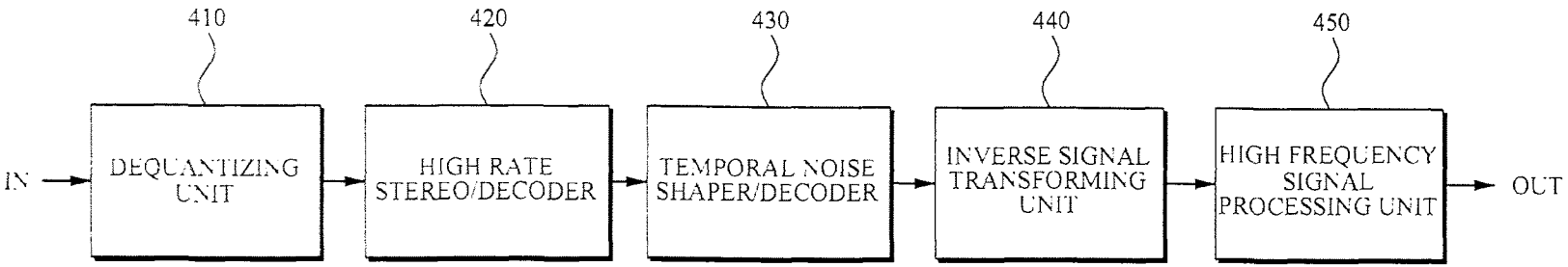
FIG. 4 is a block diagram illustrating an apparatus to decode an audio/speech signal according to exemplary embodiments of the present general inventive concept.

FIG. 4 is a block diagram illustrating an apparatus to decode an audio/speech signal according to exemplary embodiments of the present general inventive concept.

Referring to FIG. 4, the apparatus of decoding an audio/speech signal may include a dequantizing unit 410, a high rate stereo/decoder 420, a temporal noise shaper/decoder 430, an inverse signal transforming unit 440, and a high frequency signal processing unit 450.

The dequantizing unit 410 may dequantize a bitstream.

The high rate stereo/decoder 420 may decode the dequantized signal. The temporal noise shaper/decoder 430 may decode a signal where a temporal shaping is performed in an apparatus of encoding an audio/speech signal.

The inverse signal transforming unit 440 may inverse-transform the decoded signal into an audio signal or speech signal of a time domain. An inverse MDCT may be used as the inverse signal transforming unit 440.

The high frequency signal processing unit 450 may process a high frequency signal of the inverse-transformed decoded signal.

Figure 5:
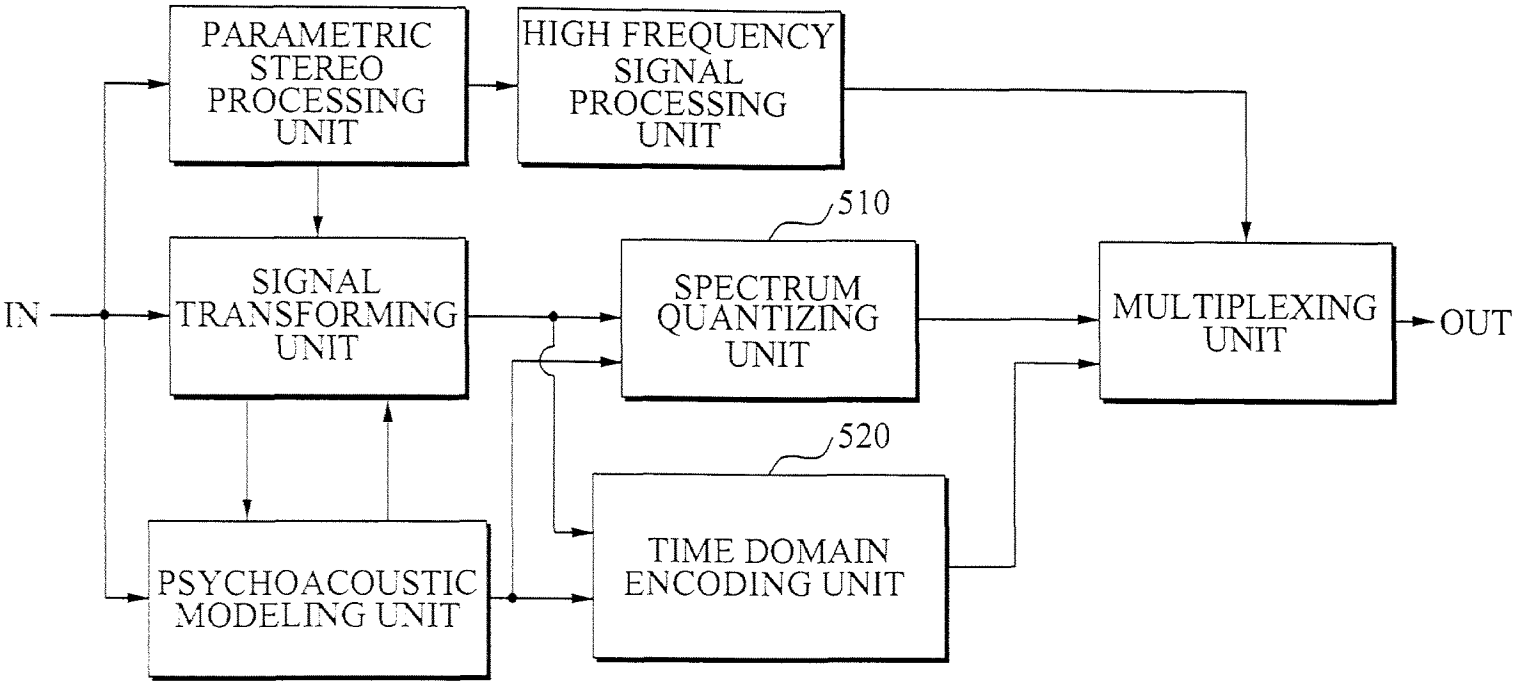
FIG. 5 is a block diagram illustrating an apparatus to encode an audio/speech signal according to exemplary embodiments of the present general inventive concept.

FIG. 5 is a block diagram illustrating an apparatus to encode an audio/speech signal according to exemplary embodiments of the present general inventive concept.

Referring to FIG. 5, a CELP unit may be included in a time domain encoding unit 520 of the apparatus of encoding an audio/speech signal, whereas the CELP unit may be included in the quantizing unit 140 in FIG. 1.

That is, the time domain encoding unit 520 may include a short-term predictor, a long-term predictor, and the CELP unit. The CELP unit may indicate an excitation modeling module to model a signal where correlation information is removed.

When a signal transforming unit transforms an inputted audio signal or speech signal into a high temporal resolution signal under control of a psychoacoustic modeling unit, the time domain encoding unit 130 may encode the transformed high temporal resolution signal without quantizing the high temporal resolution signal in a spectrum quantizing unit 510 or, alternatively, by minimizing the quantizing the high temporal resolution signal in a spectrum quantizing unit 510.

The CELP unit included in the time domain encoding unit 520 may encode a residual signal of short-term correlation information and long-term correlation information.

Figure 6:
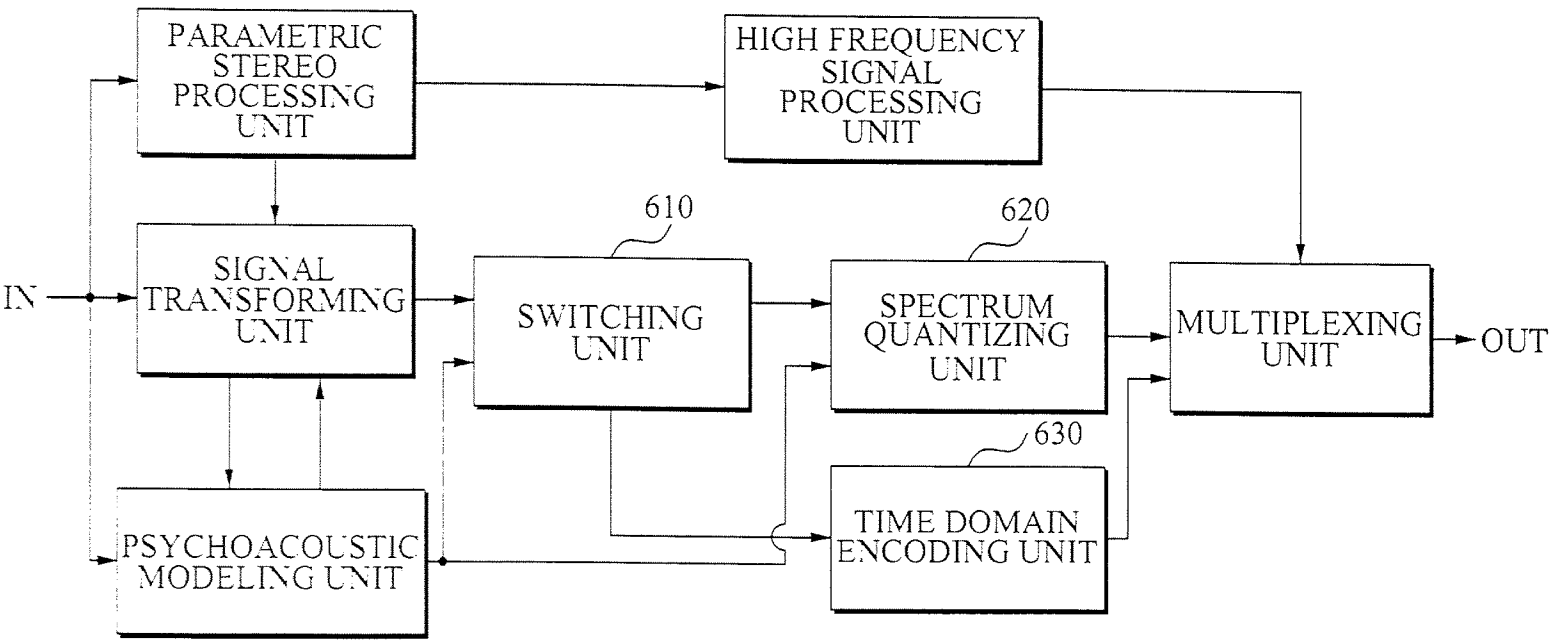
FIG. 6 is a block diagram illustrating an apparatus to encode an audio/speech signal according to exemplary embodiments of the present general inventive concept.

FIG. 6 is a block diagram illustrating an apparatus to encode an audio/speech signal according to exemplary embodiments of the present general inventive concept.

Referring to FIG. 6, the apparatus to encode an audio/speech signal illustrated in FIG. 1 may further include a switching unit 610.

The switching unit 610 may select any one or more quantizing of a quantizing unit 620 and encoding of a time domain encoding unit 630 with at least the information about time domain encoding or frequency domain encoding. The quantizing unit 620 may be a spectrum quantizing unit.

Figure 7:
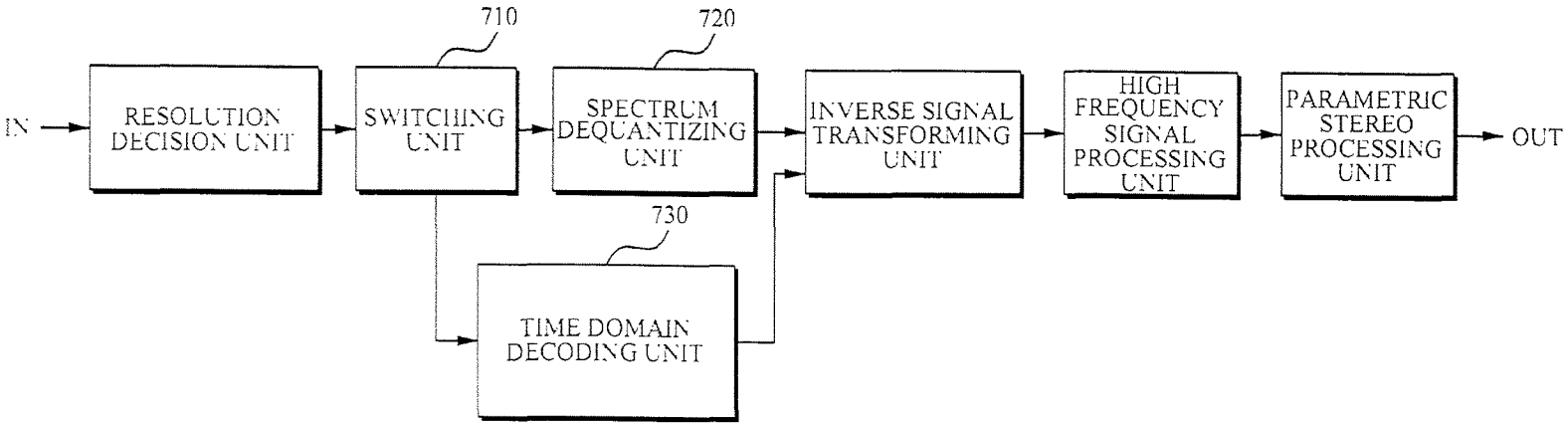
FIG. 7 is a block diagram illustrating apparatus to decode an audio/speech signal according to exemplary embodiments of the present general inventive concept.

FIG. 7 is a block diagram illustrating an apparatus to decode an audio/speech signal according to exemplary embodiments of the present general inventive concept.

Referring to FIG. 7, the apparatus to decode an audio/speech signal illustrated in FIG. 2 may further include a switching unit 710. The switching unit 710 may control a switch to a time domain decoding unit 730 or to a spectrum dequantizing unit 720 depending at least on a determination of a resolution decision unit.

Figure 8:
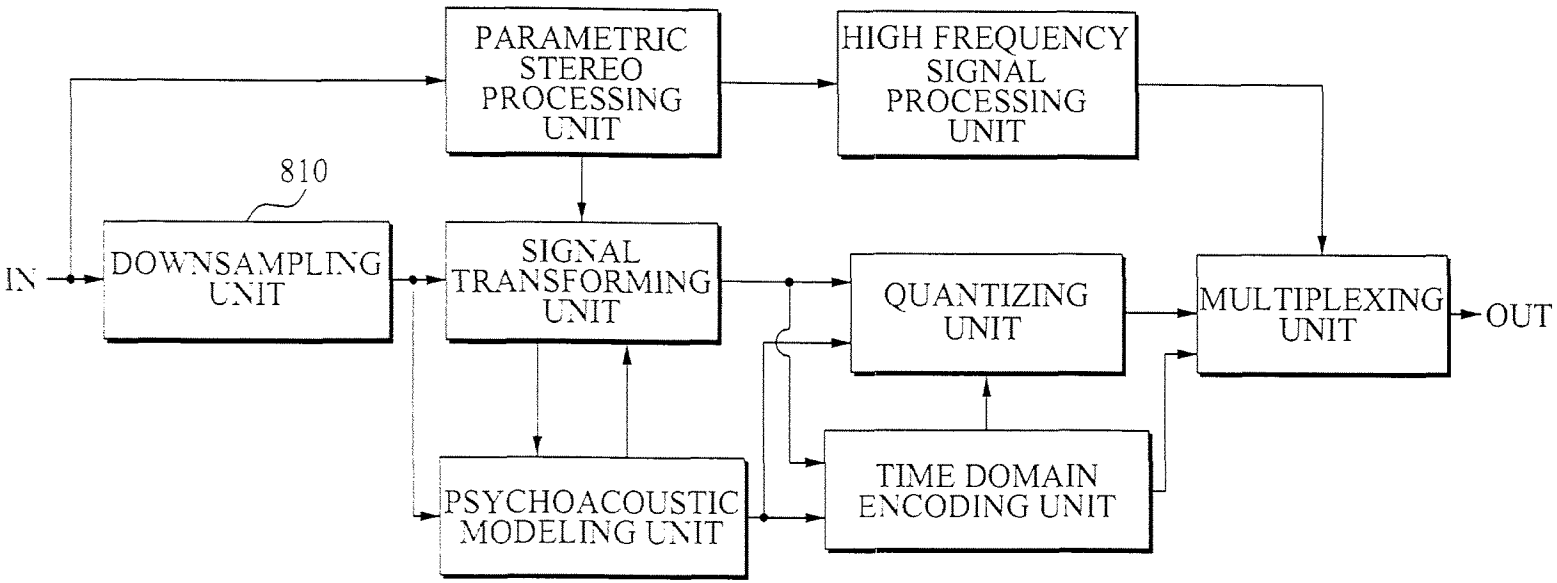
FIG. 8 is a block diagram illustrating an apparatus to encode an audio/speech signal according to exemplary embodiments of the present general inventive concept.

FIG. 8 is a block diagram illustrating an apparatus to encode an audio/speech signal according to exemplary embodiments of the present general inventive concept.

Referring to FIG. 8, the apparatus to encode an audio/speech signal illustrated in FIG. 1 may further include a downsampling unit 810.

The downsampling unit 810 may downsample an inputted signal into a low frequency signal. The low frequency signal may be generated through the downsampling, and the downsampling may be performed when the low frequency signal is in a dual rate of a high rate and a low rate. That is, the low frequency signal may be utilized when a sampling frequency of a low frequency signal encoding scheme is operated in a low sampling rate corresponding to a half or a quarter of a sampling rate of a high frequency signal processing unit. When a parametric stereo processing unit is included in the apparatus to encode an audio/speech signal, the downsampling may be performed when the parametric stereo processing unit performs a Quadrature Mirror Filter (QMF) synthesis.

In this instance, the high rate may be a rate greater than 64 kbps, and the low rate may be a rate less than 64 kbps.

Figure 9:
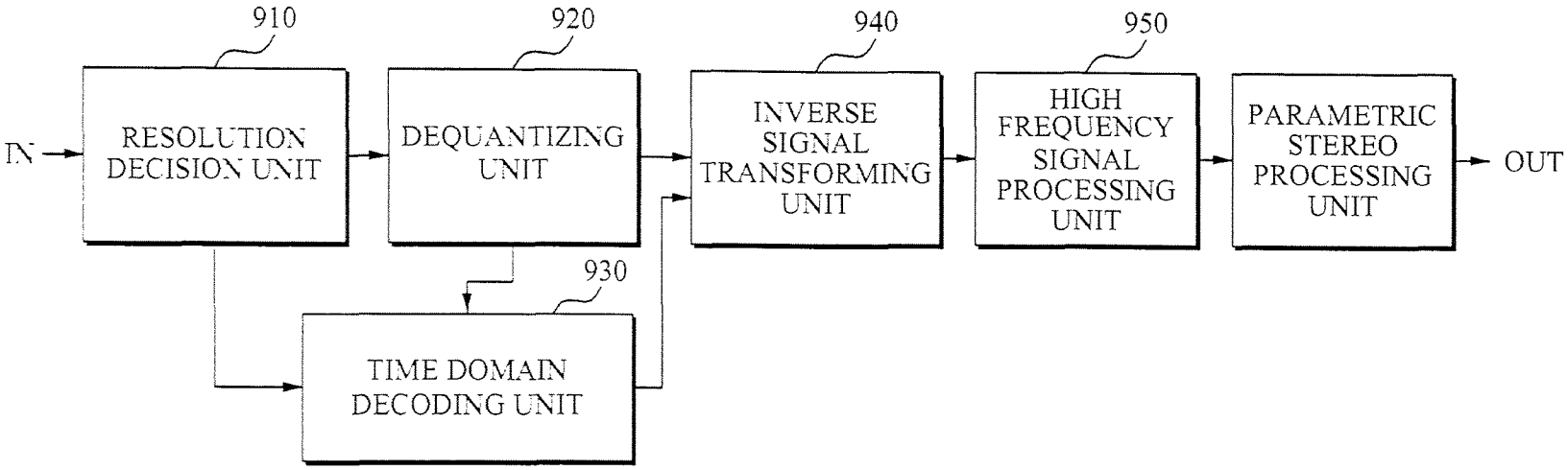
FIG. 9 is a block diagram illustrating an apparatus to decode an audio/speech signal according to exemplary embodiments of the present general inventive concept.

FIG. 9 is a block diagram illustrating an apparatus to decode an audio/speech signal according to exemplary embodiments of the present general inventive concept.

A resolution decision unit 910 may determine whether a current frame signal is a high frequency resolution signal or a high temporal resolution signal, based at least in part on information about time domain encoding or frequency domain encoding. The information may be included in a bitstream.

A dequantizing unit 920 may dequantize the bitstream based on an output signal of the resolution decision unit 910.

A time domain decoding unit 930 may receive an encoded residual signal from the dequantizing unit 920, decode additional information for inverse linear prediction from the bitstream, and restore the high temporal resolution signal using the additional information and the residual signal.

An inverse signal transforming unit 940 may inverse-transform an output signal from the time domain decoding unit 930 and/or the dequantized signal from the dequantizing unit 920 into an audio signal or speech signal of a time domain.

In this instance, a high frequency signal processing unit 950 may perform up-sampling in the apparatus of decoding an audio/speech signal of FIG. 9.

Figure 10:
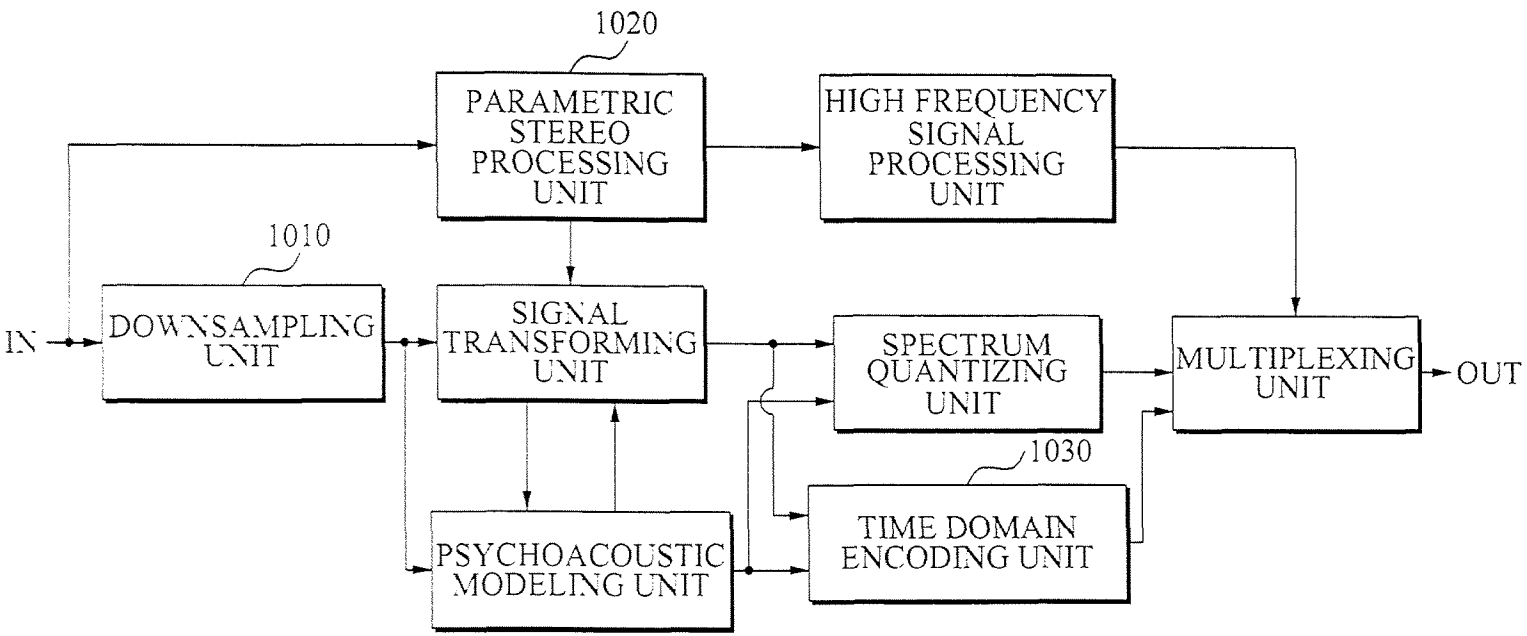
FIG. 10 is a block diagram illustrating an apparatus to encode an audio/speech signal according to exemplary embodiments of the present general inventive concept.

FIG. 10 is a block diagram illustrating an apparatus to encode an audio/speech signal according to exemplary embodiments of the present general inventive concept.

Referring to FIG. 10, the apparatus to encoding an audio/speech signal illustrated in FIG. 5 may further include a downsampling unit 1010. That is, a low frequency signal may be generated through downsampling.

When a parametric stereo processing unit 1020 is applied, the downsampling unit 1010 may perform downsampling when the parametric stereo processing unit 1020 may perform QMF synthesis for generating a downmix signal. A time domain encoding unit 1030 may include a short-term predictor, a long-term predictor, and a CELP unit.

Figure 11:
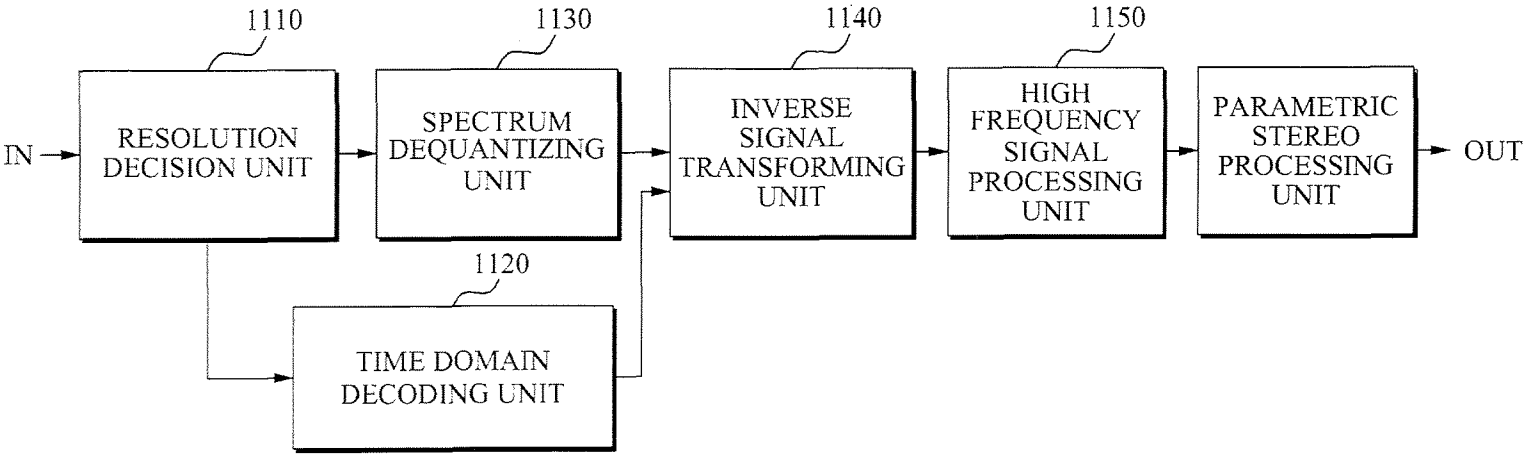
FIG. 11 is a block diagram illustrating an apparatus to decode an audio/speech signal according to exemplary embodiments of the present general inventive concept.

FIG. 11 is a block diagram illustrating an apparatus to decode an audio/speech signal according to exemplary embodiments of the present general inventive concept.

A resolution decision unit 1110 may determine whether a current frame signal is a high frequency resolution signal or a high temporal resolution signal, based on information about time domain encoding or frequency domain encoding. The information may be included in a bitstream.

A spectrum dequantizing unit 1130 may dequantize the bitstream based at least in part on an output signal of the resolution decision unit 1110, when the resolution decision unit 1110 determines that the current frame signal is the high frequency resolution signal.

When the resolution decision unit 1110 determines that the current frame signal is the high temporal resolution signal, a time domain decoding unit 1120 may restore the high temporal resolution signal.

An inverse signal transforming unit 1140 may inverse-transform an output signal from the time domain decoding unit 1120 and/or the dequantized signal from the spectrum dequantizing unit 1130 into an audio signal or speech signal of a time domain.

Also, a high frequency signal processing unit 1150 may perform up-sampling in the apparatus of decoding an audio/speech signal of FIG. 11.

Figure 12:
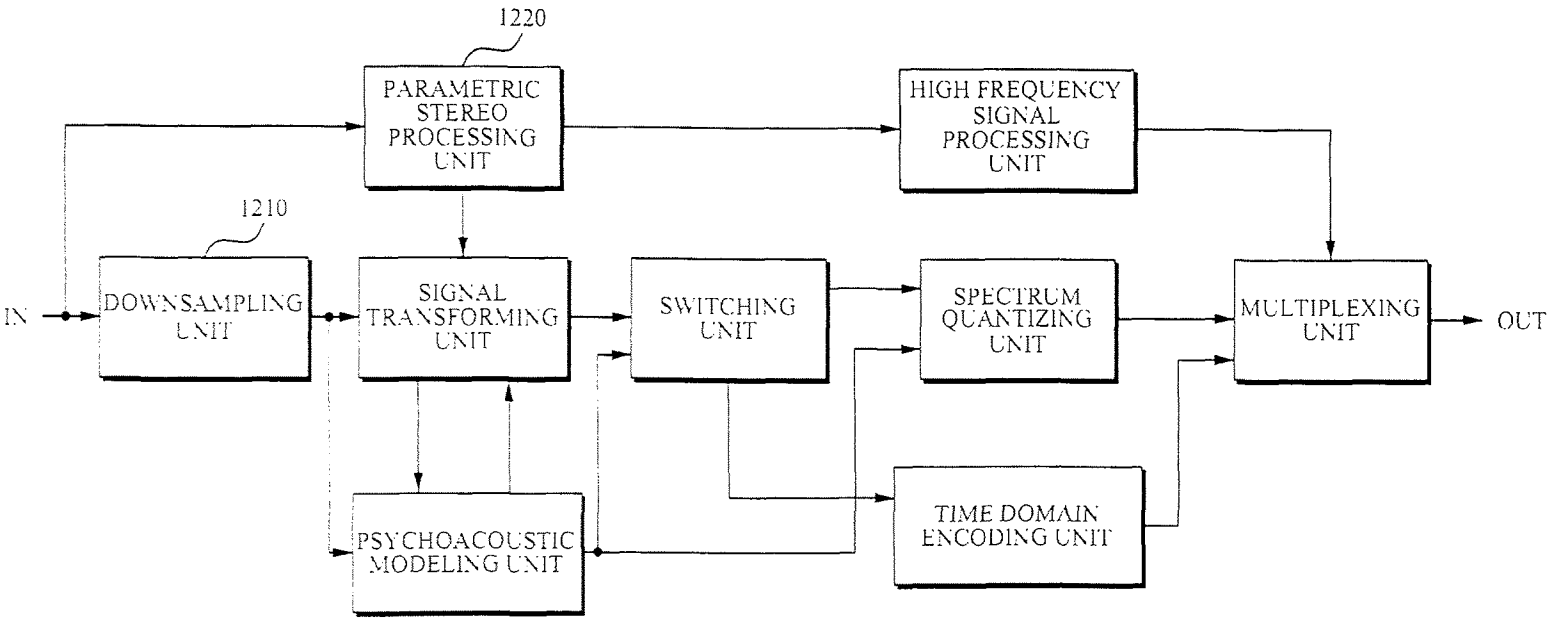
FIG. 12 is a block diagram illustrating an apparatus of encoding an audio/speech signal according to exemplary embodiments of the present general inventive concept.

FIG. 12 is a block diagram illustrating an apparatus to encode an audio/speech signal according to exemplary embodiments of the present general inventive concept.

Referring to FIG. 12, the apparatus to encode an audio/speech signal illustrated in FIG. 6 may include a downsampling unit 1210. That is, a low frequency signal may be generated through downsampling.

When a parametric stereo processing unit 1220 is applied, the downsampling unit 1210 may perform downsampling when the parametric stereo processing unit 1220 performs a QMF synthesis.

An up/down sampling factor of the apparatus of encoding an audio/speech signal of FIG. 12 may be, for example, a half or a quarter of a sampling rate of a high frequency signal processing unit. That is, when a signal is inputted in 48 kHz, 24 kHz or 12 kHz may be available through the up/down sampling.

Figure 13:
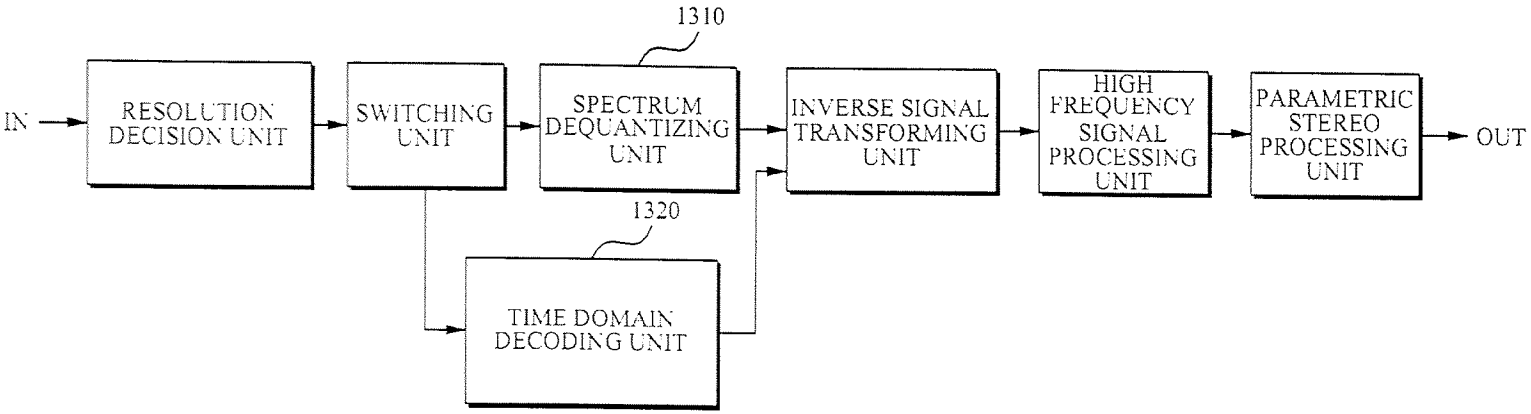
FIG. 13 is a block diagram illustrating an apparatus to decode an audio/speech signal according to exemplary embodiments of the present general inventive concept.

FIG. 13 is a block diagram illustrating an apparatus to decode an audio/speech signal according to exemplary embodiments of the present general inventive concept.

Referring to FIG. 13, the apparatus to decode an audio/speech signal illustrated in FIG. 2 may further include a switching unit. That is, the switching unit may control a switch to a time domain decoding unit 1320 or to a spectrum dequantizing unit 1310.

Figure 14:
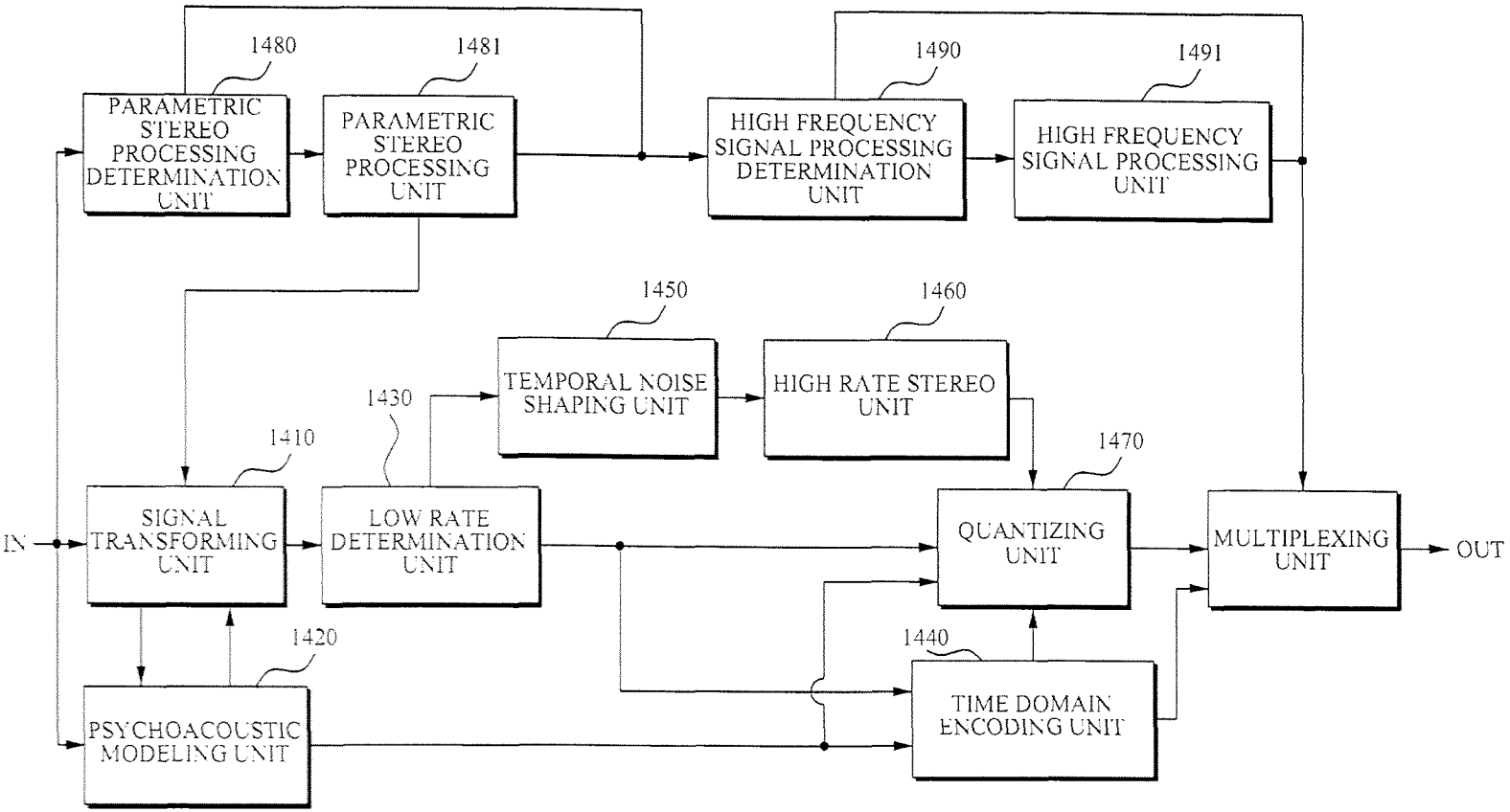
FIG. 14 is a block diagram illustrating an apparatus to encode an audio/speech signal according to exemplary embodiments of the present general inventive concept.

FIG. 14 is a block diagram illustrating an apparatus to encode an audio/speech signal according to exemplary embodiments of the present general inventive concept.

Referring to FIG. 14, the apparatus to encode an audio/speech signal illustrated in FIG. 1 and the apparatus to encode an audio/speech signal illustrated in FIG. 3 may be combined at least in part.

That is, when a transformed signal is at a low rate as a result of determining by a low rate determination unit 1430 based on a predetermined low rate and high rate, a signal transforming unit 1410, a time domain encoding unit 1440, and a quantizing unit 1470 may be operated. When the transformed signal is at the high rate, the signal transforming unit 1410, a temporal noise shaping unit 1450, and a high rate stereo unit 1460 may be operated.

A parametric stereo processing unit 1481 and a high frequency signal processing unit 1491 may be turned on/off based on a predetermined standard. Also, the high rate stereo unit 1460 and the parametric stereo processing unit 1481 may not be simultaneously operated. Also, the high frequency signal processing unit 1491 and the parametric stereo processing unit 1481 may be respectively operated under control of a high frequency signal processing determination unit 1490, and a parametric stereo processing determination unit 1480 based on predetermined information.

Figure 15:
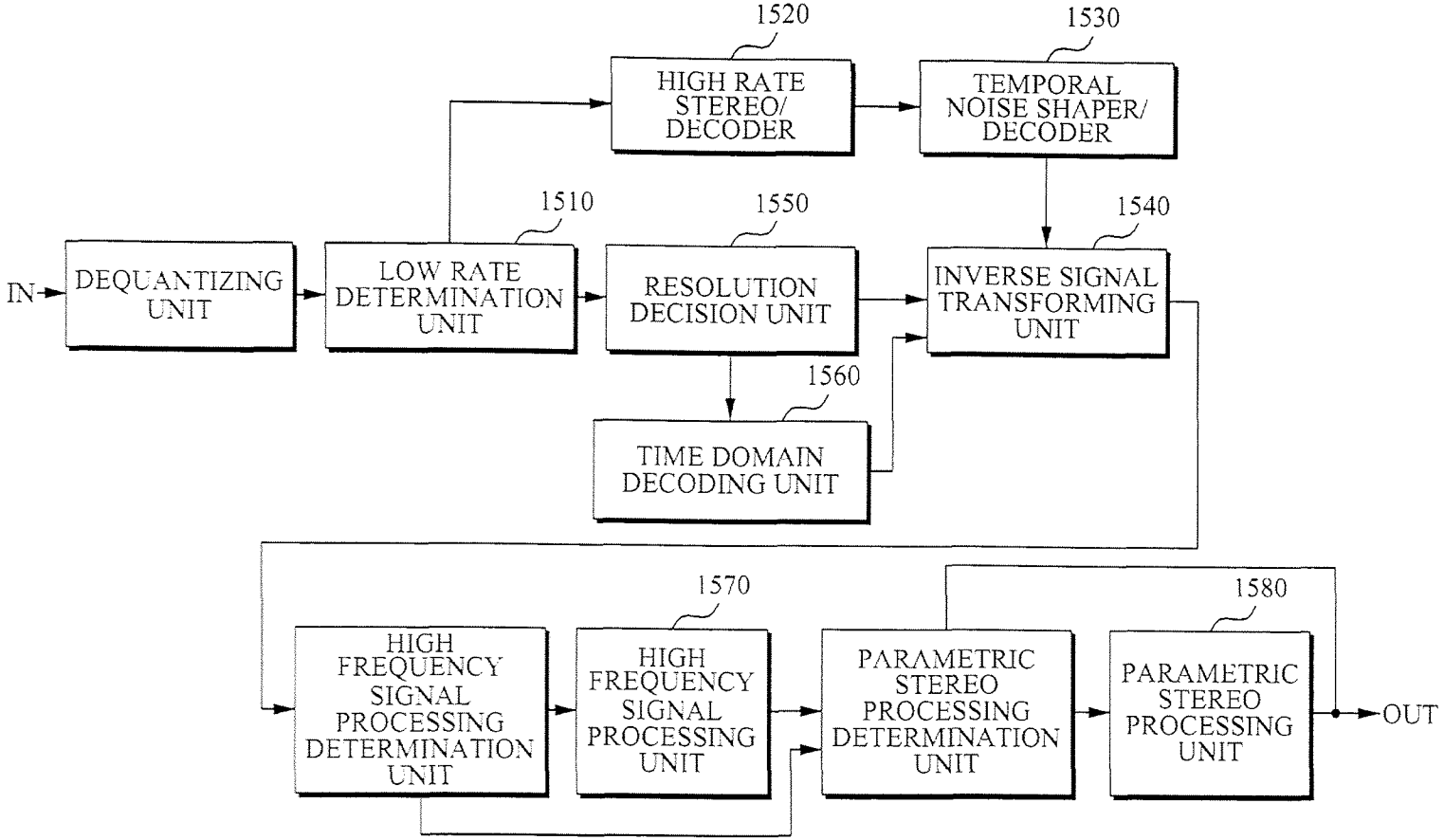
FIG. 15 is a block diagram illustrating an apparatus to decode an audio/speech signal according to exemplary embodiments of the present general inventive concept.

FIG. 15 is a block diagram illustrating an apparatus to decode an audio/speech signal according to exemplary embodiments of the present general inventive concept.

Referring to FIG. 15, the apparatus to decode an audio/speech signal illustrated in FIG. 2 and the apparatus to decode an audio/speech signal illustrated in FIG. 4 may be combined, at least in part.

That is, when a transformed signal is at a high rate as a result of determining of a low rate determination unit 1510, a high rate stereo/decoder 1520, a temporal noise shaper/decoder 1530, and inverse signal transforming unit 1540 may be operated. When the transformed signal is at a low rate, a resolution decision unit 1550, a time domain decoding unit 1560, and a high frequency signal processing unit 1570 may be operated. Also, the high frequency signal processing unit 1570 and the parametric stereo processing unit 1580 may be operated under control of a high frequency signal processing determination unit and a parametric stereo processing determination unit based on predetermined information, respectively.

Figure 16:
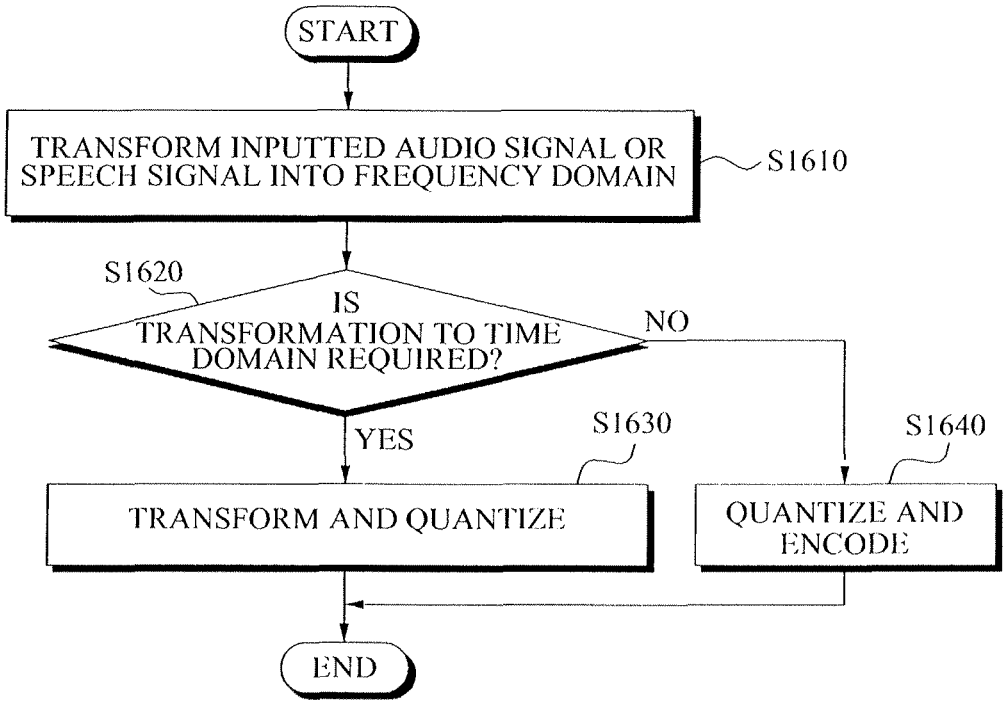
FIG. 16 is a flowchart diagram illustrating a method of encoding an audio/speech signal according to exemplary embodiments of the present general inventive concept.

FIG. 16 is a flowchart diagram illustrating a method of encoding an audio/speech signal according to exemplary embodiments of the present general inventive concept.

In operation S1610, an inputted audio signal or speech signal may be transformed into a frequency domain. In operation S1620, it may be determined whether a transform to a time domain is to be performed.

An operation of downsampling the inputted audio signal or speech signal may be further included.

According to at least a result of the determining in operation S1620, the inputted audio signal or speech signal may be transformed into a high frequency resolution signal and/or a high temporal resolution signal in operation S1630.

That is, when the transform to the time domain is to be performed, the inputted audio signal or speech signal may be transformed into the high temporal resolution signal and be quantized in operation S1630. When the transform to the time domain will not be performed, the inputted audio signal or speech signal may be quantized and encoded in operation S1640.

Figure 17:
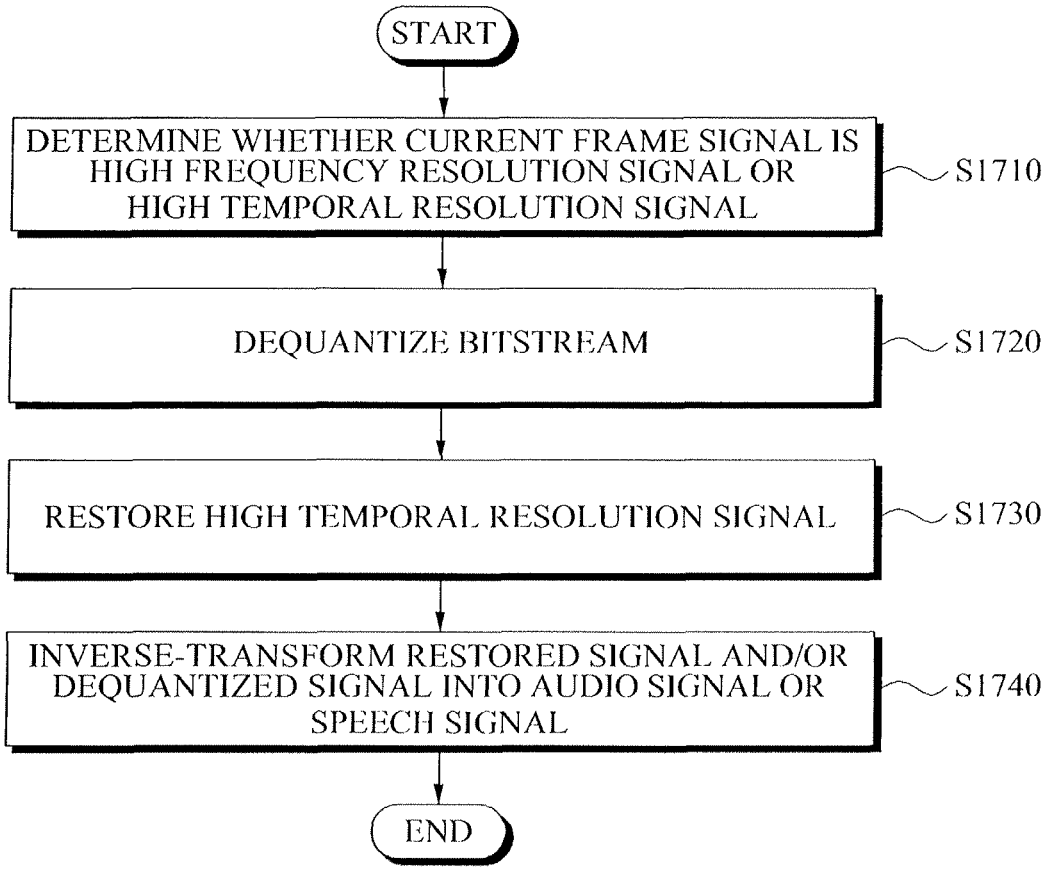
FIG. 17 is a flowchart diagram illustrating a method of decoding an audio/speech signal according to exemplary embodiments of the present general inventive concept.

FIG. 17 is a flowchart diagram illustrating a method of decoding an audio/speech signal according to an exemplary embodiment of the present general inventive concept.

In operation S1710, it may be determined whether a current frame signal is a high frequency resolution signal or a high temporal resolution signal.

In this instance, the determination may be based on information about time domain encoding or frequency domain encoding, and the information may be included in a bitstream.

In operation S1720, the bitstream may be dequantized.

In operation S1730, the dequantized signal may be received, additional information for inverse linear prediction may be decoded from the bitstream, and the high temporal resolution signal may be restored using the additional information and an encoded residual signal.

In operation S1740, the signal outputted from a time domain decoding unit and/or the dequantized signal from a dequantizing unit may be inverse-transformed into an audio signal or speech signal of a time domain.

The present general inventive concept can also be embodied as computer-readable codes on a computer-readable medium. The computer-readable medium can include a computer-readable recording medium and a computer-readable transmission medium. The computer-readable recording medium is any data storage device that can store data as a program which can be thereafter read by a computer system. Examples of the computer-readable recording medium include read-only memory (ROM), random-access memory (RAM), CD-ROMs, magnetic tapes, floppy disks, and optical data storage devices. The computer-readable recording medium can also be distributed over network coupled computer systems so that the computer-readable code is stored and executed in a distributed fashion. The computer-readable transmission medium can transmit be transmitted through carrier waves or signals (e.g., wired or wireless data transmission through the Internet). Also, functional programs, codes, and code segments to accomplish the present general inventive concept can be easily construed by programmers skilled in the art to which the present general inventive concept pertains.

Although several example embodiments of the present general inventive concept have been illustrated and described, it would be appreciated by those skilled in the art that changes may be made in these example embodiments without departing from the principles and spirit of the general inventive concept, the scope of which is defined in the claims and their equivalents.

What is claimed is:

1. An apparatus to encode an audio/speech signal, the apparatus comprising:

a signal transforming unit to transform an inputted audio signal or speech signal into at least one of a high frequency resolution signal and a high temporal resolution signal;

a psychoacoustic modeling unit to control the signal transforming unit;

a time domain encoding unit to encode the signal, transformed by the signal transforming unit, based on a speech modeling; and a quantizing unit to quantize the signal outputted from at least one of the signal transforming unit and the time domain encoding unit.

2. The apparatus of claim 1, wherein the quantizing unit includes a Code Excitation Linear Prediction (CELP) to model a signal where correlation information is removed.

3. An apparatus to encode an audio/speech signal, the apparatus comprising:

a parametric stereo processing unit to process stereo information of an inputted audio signal or speech signal;

a high frequency signal processing unit to process a high frequency signal of the inputted audio signal or speech signal;

a signal transforming unit to transform the inputted audio signal or speech signal into at least one of a high frequency resolution signal and a high temporal resolution signal;

a psychoacoustic modeling unit to control the signal transforming unit;

a time domain encoding unit to encode the signal, transformed by the signal transforming unit, based on a speech modeling; and a quantizing unit to quantize the signal outputted from at least one of the signal transforming unit and the time domain encoding unit.

4. The apparatus of claim 3, wherein the time domain encoding unit includes a CELP to model a signal where correlation information is removed.

5. The apparatus of claim 3, wherein the quantizing unit is a spectrum quantizing unit, and further comprises:

a switching unit to select any one of the outputted signals from the spectrum quantizing unit and the time domain encoding unit depending on whether the transformed audio signal or speech signal is the high frequency resolution signal or the high temporal resolution signal.

6. The apparatus of claim 3, further comprising:

a downsampling unit to downsample the audio signal or speech signal.

7. The apparatus of claim 3, wherein the signal transforming unit includes at least one of a Frequency Varying Modulated Lapped Transform (FV-MLT) and a Modified Discrete Cosine Transform (MDCT).

8. The apparatus of claim 3, wherein the psychoacoustic modeling unit provides the quantizing unit with information about a noise during quantization.

9. The apparatus of claim 3, wherein the time domain encoding unit further comprises:

a predicting unit to apply the speech modeling to the signal transformed by the signal transforming unit, and to remove correlation information.

10. An apparatus to decode audio/speech signal, the apparatus comprising:

a resolution decision unit to determine whether a current frame signal is a high frequency resolution signal or a high temporal resolution signal, based on information about time domain encoding or frequency domain encoding, the information being included in a bitstream;

a dequantizing unit to dequantize the bitstream when the resolution decision unit determines the signal is the high frequency resolution signal;

a time domain decoding unit to decode additional information for inverse linear prediction from the bitstream, and to restore the high temporal resolution signal using the additional information; and an inverse signal transforming unit to inverse-transform at least one of an output signal from the time domain decoding unit and an output signal from the dequantizing unit into an audio signal or speech signal of a time domain.

11. The apparatus of claim 10, wherein the apparatus further comprises at least one of:

a high frequency signal decoding unit to process a high frequency signal of the inverse-transformed signal, and a parametric stereo processing unit to process stereo information of the inverse-transformed signal.

12. An apparatus to encoding an audio/speech signal, the apparatus comprising:

a signal transforming unit to transform an inputted audio signal or speech signal into at least one of a high frequency resolution signal and a high temporal resolution signal;

a psychoacoustic modeling unit to control the signal transforming unit;

a temporal noise shaping unit to shape at least one of the transformed high frequency resolution signal and the transformed high temporal resolution signal;

a high rate stereo unit to encode stereo information of the transformed signal; and a quantizing unit to quantize the signal outputted from at least one of the temporal noise shaping unit and the high rate stereo unit.

13. The apparatus of claim 12, further comprising:

a high frequency signal processing unit to process a high frequency signal of the audio signal or the speech signal.

14. An apparatus of decoding an audio/speech signal, the apparatus comprising:

a dequantizing unit to dequantize a bitstream;

a high rate stereo/decoder to decode the dequantized signal;

a temporal noise shaper/decoder to process the signal decoded by the high rate stereo/decoder; and an inverse signal transforming unit to inverse-transform the processed signal into an audio signal or speech signal of a time domain, wherein the bitstream is generated by a transformation of the inputted audio signal or speech signal into at least one of a high frequency resolution signal and a high temporal resolution signal.

15. The apparatus of claim 14, further comprising:

a high frequency signal processing unit to process a high frequency signal of the inverse-transformed signal.

16. An apparatus to encode an audio/speech signal, the apparatus comprising:

a signal transforming unit to transform an inputted audio signal or speech signal into at least one of a high frequency resolution signal and a high temporal resolution signal;

a psychoacoustic modeling unit to control the signal transforming unit;

a low rate determination unit to determine whether the transformed signal has a low rate;

a time domain encoding unit to encode the transformed signal based on a speech modeling when the transformed signal has the low rate;

a temporal noise shaping unit to shape the transformed signal;

a high rate stereo unit to encode stereo information of the shaped signal; and a quantizing unit to quantize at least one of an output signal from the high rate stereo unit and an output signal from the time domain encoding unit.

17. The apparatus of claim 16, further comprising:

a parametric stereo processing determination unit to determine whether to operate a parametric stereo processing unit based on predetermined information;

the parametric stereo processing unit to process stereo information of an inputted high frequency signal when it is determined that the parametric stereo processing unit is to be operated;

a high frequency signal processing determination unit to determine whether to operate a high frequency signal processing unit based on other predetermined information; and the high frequency signal processing unit to process an inputted high frequency signal when it is determined that the high frequency signal processing unit is to be operated.

18. A method of encoding an audio/speech signal, the method comprising:

transforming an inputted audio signal or speech signal into at least one of a high frequency resolution signal and a high temporal resolution signal, and controlling the transformed signal based on a psychoacoustic modeling;

time-encoding the transformed signal based at least in part on a speech modeling; and quantizing at least one of the transformed signal and the time-encoded signal.

19. A method of decoding an audio/speech signal, the method comprising:

determining whether a current frame signal is a high frequency resolution signal or a high temporal resolution signal, based at least in part on information included in the bitstream about time domain encoding or frequency domain encoding;

dequantizing the bitstream when the signal is determined as the high frequency resolution signal;

decoding additional information for inverse linear prediction from the bitstream, and restoring the high temporal resolution signal using the additional information; and inverse-transforming at least one of the restored signal and the dequantized signal into an audio signal or speech signal of a time domain.

20. A method of encoding audio and speech signals, the method comprising:

receiving at least one audio signal and at least one speech signal;

transforming the at least one of the received audio signal and the received speech signal into at least one of a frequency resolution signal and a temporal resolution signal;

encoding the transformed signal; and quantizing at least one of the transformed signal and the encoded signal.

21. A method of decoding an audio or speech signal, the method comprising:

checking whether a signal has been encoded in a frequency domain or a time domain;

loss-less decoding and dequantizing the signal encoded in the frequency domain;

reconstructing the signal encoded in the time domain by using a Code Excitation Linear Prediction (CELP);

inverse-transforming the decoded and dequantized signal to a time domain signal;

generating a high frequency band signal using either the inverse-transformed signal or the reconstructed signal; and generating a stereo signal from the high frequency band signal and either the inverse-transformed signal or the reconstructed signal.

22. The method of claim 21, wherein the CELP comprises at least a long-term predictor.

23. The method of claim 22 further comprising:

performing a temporal noise shaping on the decoded and dequantized signal, if the checking result shows that the signal has been encoded in the frequency domain.

* * * * *